US005695062A

United States Patent [19]

Lemaire

[11] Patent Number: 5,695,062

[45] Date of Patent: Dec. 9, 1997

[54] EGG BOX

[75] Inventor: Réal Lemaire, Drummondville, Canada

[73] Assignee: Real-Pac Enr., Acton Vale, Canada

[21] Appl. No.: 705,084

[22] Filed: Aug. 27, 1996

Related U.S. Application Data

[63] Continuation of Ser. No. 528,745, Sep. 15, 1995, abandoned, which is a continuation of Ser. No. 269,182, Jun. 30, 1994, abandoned.

[30] Foreign Application Priority Data

Jun. 30, 1993 [CA] Canada ..... 2099471

[51] Int. Cl.[6] ..... B65D 81/20

[52] U.S. Cl. ..... 206/521.8; 206/521.1; 220/508; 220/339

[58] Field of Search ..... 229/407; 220/507, 220/508, 339; 206/521.8, 521.6, 521.1

[56] References Cited

U.S. PATENT DOCUMENTS

| | | | |
|---|---|---|---|
| 2,591,471 | 4/1952 | Schwertfeger | 206/521.1 |
| 2,634,039 | 4/1953 | Schwertfeger | 206/521.1 |
| 2,843,304 | 7/1958 | Reifers | 206/521.1 |
| 3,568,915 | 3/1971 | Newman | 229/45 |
| 3,580,480 | 5/1971 | French | 229/45 |
| 3,688,971 | 9/1972 | Phillips et al. | 229/44 R |
| 3,771,712 | 11/1973 | Richards | 229/2.5 |
| 3,790,063 | 2/1974 | Moller | 229/29 M |
| 3,963,172 | 6/1976 | Holzwarth et al. | 229/44 EC |
| 4,059,219 | 11/1977 | Reifers et al. | 229/2.5 EC |
| 4,170,315 | 10/1979 | Dubach et al. | 220/339 X |
| 4,235,334 | 11/1980 | Ahn | 220/339 X |
| 4,235,346 | 11/1980 | Liggett | 220/339 X |
| 4,795,080 | 1/1989 | McIntyre | 206/521.1 X |

*Primary Examiner*—Allan N. Shoap
*Assistant Examiner*—Robin A. Hylton
*Attorney, Agent, or Firm*—Baker & Botts, L.L.P.

[57] ABSTRACT

A box with improved fastener means. The box has a member and two trays, where the member is positioned between the two trays and connected to the trays. Each of the trays has at least one article receiving pocket and a lid that is hinged to the respective tray along the outer edge of the box, opposite the member. The box has a groove of dovetailed cross-section. The groove includes the member, positioned at the bottom of the groove, and two opposed lateral walls projecting from the member. Each of the lateral walls is attached to a respective tray. The two lids are reversibly fastened to the groove. The lids are formed to contain rims that are substantially either reverse "Z" shaped or "Z" shaped, with each rim having a tongue which is placed within the groove when the lid is closed. In the closed position, the rim fits within the groove and against the lateral wall of the groove which is closest to it. Since the dovetailed groove has decreasing width as the vertical distance from the bottom of the groove increases, when both rims are fitted into the groove during fastening, the tongue of the second rim lies directly above the tongue of the first rim and is forced into a slightly bowed shape, thus locking the lids in the closed position.

10 Claims, 5 Drawing Sheets

EGG BOX

This is a continuation of application Ser. No. 08/528,745 filed on Sep. 15, 1995, now abandoned which is a continuation of application Ser. No. 08/269,182 filed on Jun. 30, 1994, now abandoned.

(a) Field of the Invention

The present invention concerns a box, namely an egg box, provided with a base, at least two lids and a fastener for said lids and said base. The invention also concerns a method for closing said lids and said base.

(b) Brief Description of the Prior Art

The U.S. Pat. No. 3,580,480 concerns a box of the type comprising a body provided with a bottom wall, a pair of side walls and a pair of end walls, and a pair of lids. Each lid includes a simple-ply locking panel that is positioned along a central line of the box's body, when said lids are in a closed position. Each locking panel shows a free end, wall means located along the central line of the body and slot means for receiving said locking means when the lids are in a closed position. Finally, the box of the U.S. Pat. No. 3,580,480 comprises means for interconnecting locking panels inside the slot means, when the lids are in a closed position, said interconnecting means having the shape of projections toward the outside for a frictional engagement with wall means when the lids are in the closed position, said projections projecting toward different side walls.

The above-mentioned box of the prior art cannot allow the closure of a box when this latter is moved continuously on conveying means nor effectively prevent the accidental opening of the box during its handling. Furthermore, such a box in the prior art cannot have its sturdiness substantially increased.

Therefore, there is a strong need for a box, namely an egg box, capable of preventing the drawbacks associated with the prior art.

SUMMARY OF THE INVENTION

The present invention overcomes drawbacks noted with the boxes belonging to the prior art, namely egg boxes.

Advantageously, the present invention concerns a box, namely an egg box, that may be closed very easily on conveyor means, namely conveyor means comprising a conveyor belt, when several boxes are continuously moved thereon.

Advantageously, the present invention concerns a box, namely an egg box, that prevents the accidental opening thereof, particularly when handling said box.

Advantageously, the present invention concerns a box, namely an egg box, where the fastener contributes to the whole structural sturdiness of the box. More particularly, the accidental opening of the box, namely during its handling, is prevented because of the structural sturdiness of the box and the structural characteristics of its particular fastener.

The present invention concerns also a method for closing the above-mentioned box when it is continuously moved on conveyor means.

More particularly, the present invention concerns a box, namely an egg box, of the type comprising, preferably in a single sheet of semi-rigid and molded plastic material:

a base comprising a member and a first and a second tray, said member being positioned between said trays and being an integral part of the trays; said first tray having substantially longitudinal side that is opposite the member and at least one article receiving pocket (preferably one row of egg-receiving pockets); said second tray having a substantially longitudinal side that is opposite the member and at least one article-receiving pocket (preferably one row of egg-receiving pockets);

a first and a second lid, each lid having a first and a second substantially longitudinal side;

first hinge means to pivotally connect the second longitudinal side of the first lid with the longitudinal side of the first tray;

second hinge means to pivotally connect the second longitudinal side of the second lid with the longitudinal side of the second tray;

fastening means to removably fasten together the member, the first longitudinal side of the first lid and the first longitudinal side of the second lid;

characterized in that said fastening means comprise:

a substantially longitudinal groove of dovetailed cross-section which is defined by the member and opposite first and second lateral walls;

a first rim defined by a first tongue and by a portion of the first longitudinal side of the first lid attached to said first tongue, said first rim having a cross-section substantially in the shape of a reverse "Z"; wherein the first tongue of the first rim is shaped to fit against the member and a portion of the first rim is shaped to fit against the lateral wall of the groove, when the first lid is fastened;

a second rim defined by a second tongue and by a portion of the first longitudinal side of the second lid attached to said second tongue, said second rim having a cross-section substantially in the shape of a "Z"; wherein the first tongue is between the second tongue and the member, the second tongue is substantially parallel with the member, and a portion of the second rim is shaped to fit against the second lateral wall of the groove, when the first and second lids are fastened.

Advantageously, the first and second tongues are of the same width Preferably, the second tongue is bowed upwardly due to the fact that its width is slightly greater than the width of the groove when the first and second lids are fastened with the first tongue between the second tongue and the member and adjacent to the member.

Preferably, the groove has a dovetailed cross-section; the first rim having a cross-section substantially in the shape of a reverse "Z" or a "Z" and the second rim having a cross-section substantially in the shape of a "Z" or a reverse "Z"; being understood that when the first rim is substantially shaped as a reverse "Z", the second rim is substantially shaped as a "Z" and vice versa.

Preferably, each lateral side of the groove having a dovetailed cross-section may have an angle with respect to an orthogonal plane with the member, of about 10°.

Advantageously, the first and second hinge means may consist of a molded hinge. Preferably, one molded hinge may consist in a portion of the semi-rigid sheet of plastic material that is molded to define, when the first lid is in an open position, a groove of semi-circular cross-section and when the first lid is in a closed position, a cavity of substantially circular cross-section.

Alternately, the first hinge means may comprise a weakening line between the first tray and the first lid and the second hinge means may comprise a weakening line between the second tray and the second lid. Preferably, each weakening line may be obtained with the help of slots made in the sheet of semi-rigid and molded plastic material according to techniques well-known to men skilled in the art. These techniques do not need to be further explained.

The present invention also concerns a method for the fastening of the lids of a box as defined hereinbefore, characterized in that at least one of the above-mentioned box is moved longitudinally on conveyor means (which may comprise an endless conveyor belt for carrying said boxes) with its lids already tilted to have the rim against the first groove and the second rim against the first rim, and then a tool is directly engaged against the second rim to flex and simultaneously push the first and second rims toward the member of the groove.

Preferably, the tool is stationary with respect to the conveyor means and is of the type providing when the box passes vis-à-vis the latter a high impact against said rims, in particular on said first and second tongues.

Alternatively, the tool may comprise a wheel which is stationary with respect to the conveyor means and which may roll in the same direction as the endless conveyor belt to engage said boxes accordingly.

BRIEF DESCRIPTION OF THE DRAWINGS

The present invention will be better understood when reading the non-restrictive description of preferred embodiments thereof, made in reference to the following drawings.

DETAILED DESCRIPTION OF A PREFERRED EMBODIMENT

Figure 1:
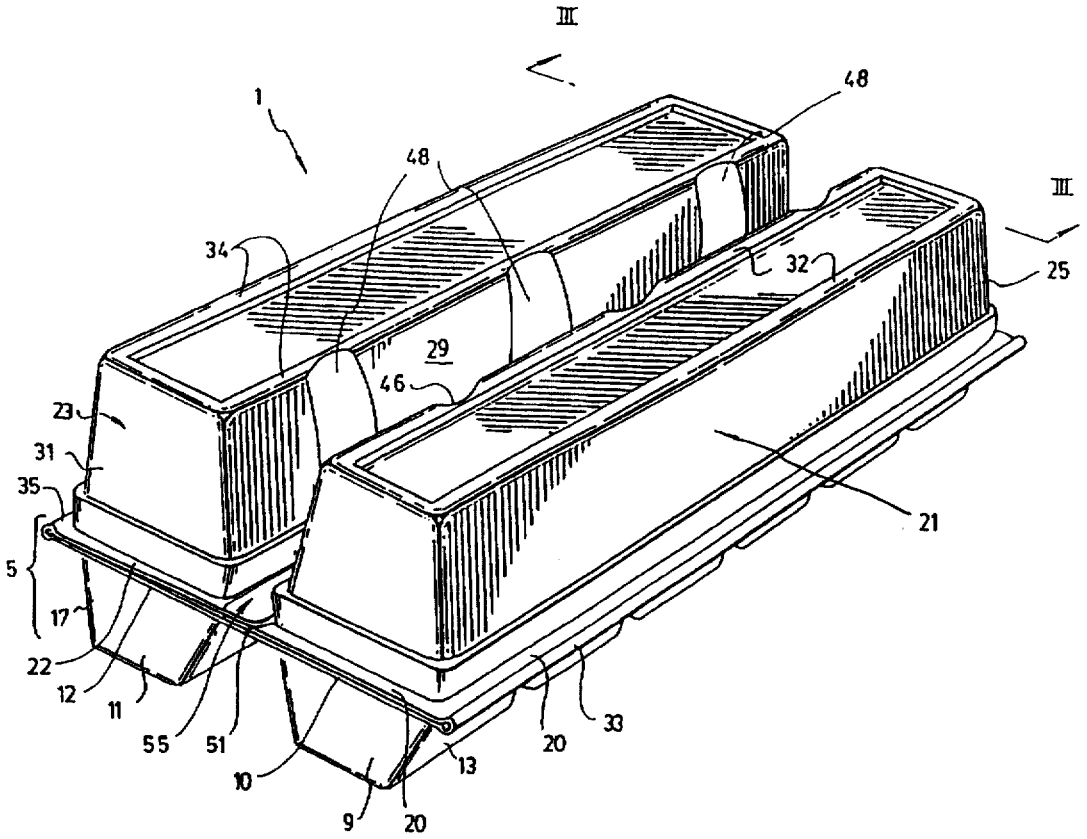
FIG. 1 is a front perspective view of a box, namely an egg box, according to the invention.
Figure 2:
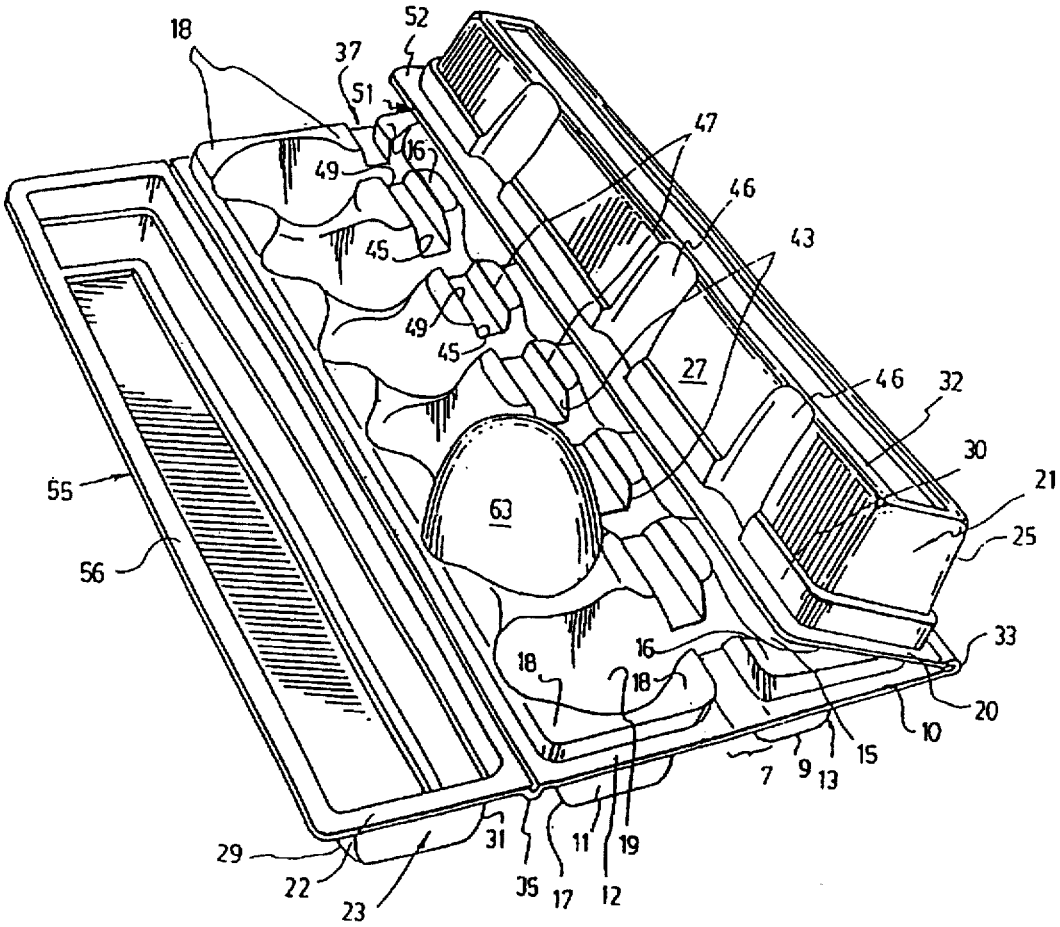
FIG. 2 is a front perspective view of the box shown on FIG. 1 with its lids respectively open and partially closed.
Figure 3A:
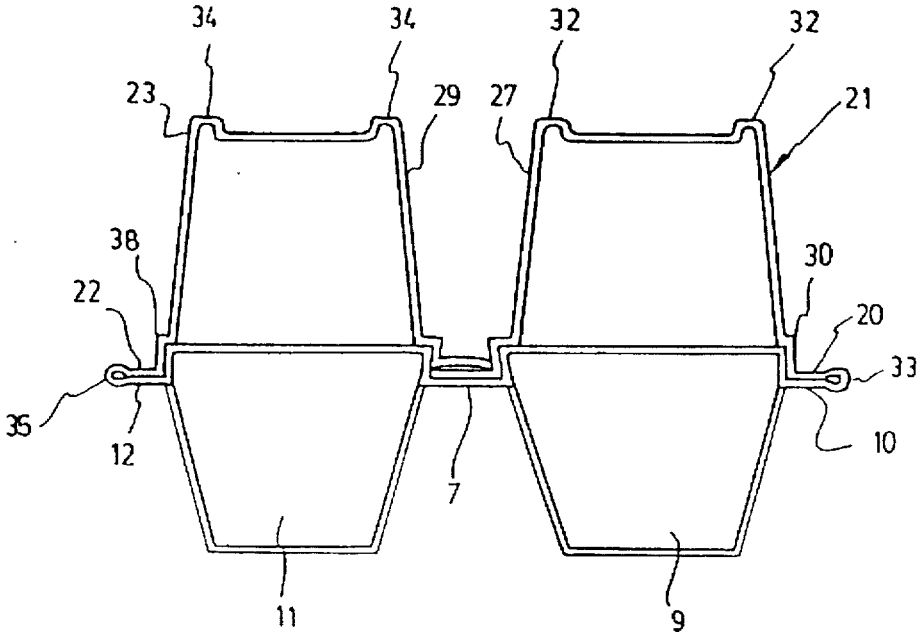
FIG. 3*a* is a cross-sectional view of the box shown on FIG. 1 according to FIG. 3*b* is an enlargement of the portion of FIG. 3*a* contained in dashed circle B.
Figure 3B:
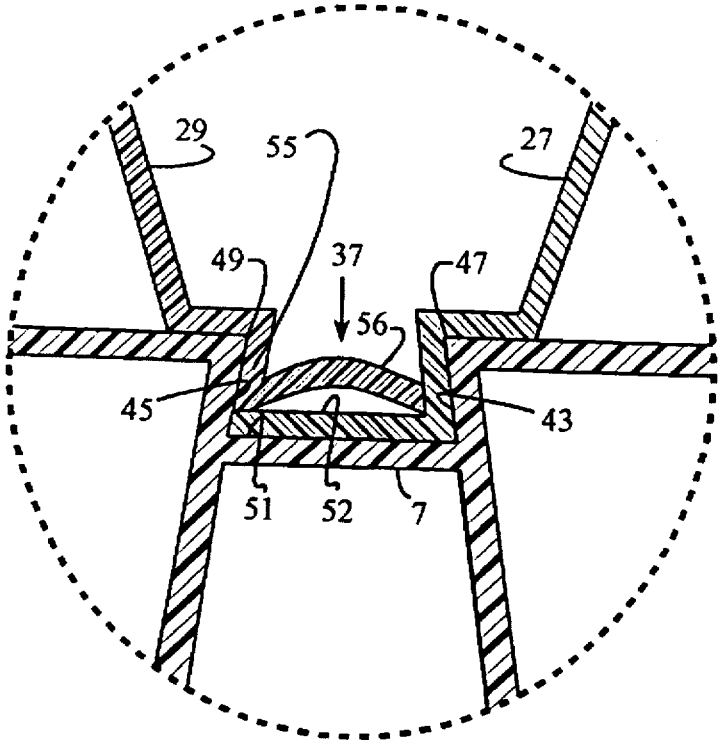

As it is illustrated in the drawings, a preferred embodiment of the invention concerns a box 1 of the type comprising a single sheet of semi-rigid and molded plastic material:

a base 5 comprising a member 7, a first tray 9 and a second tray 11, said member 7 being positioned between trays 9, 11 and being an integral part of the trays; said tray 9 having a substantially longitudinal side 13, said first tray being provided with a row of egg receiving pockets 15; said second tray 11 having a substantially longitudinal side 17, said second tray 11 being provided with a row of egg receiving pockets 19;

a first lid 21 and a second lid 23, each lid having a first 27,29 and a second 25, 31 substantially longitudinal side;

first hinge means for pivotally connecting the second longitudinal side of the first lid (i.e., longitudinal side 25) with the longitudinal side 13 of the first tray 9, said first hinge means comprising a molded hinge 33 (identical to the molded hinge 35 defined hereinafter) between the first tray 9 and the first lid 21;

second hinge means for pivotally connecting the second longitudinal side of the second lid (i.e., the longitudinal side 31) with the longitudinal side 17 of the second tray 11;

said second hinge means comprising a molded hinge 35 between the second tray 11 and the second lid 23;

fastening means to removably fasten together the member 7, the first longitudinal side 27 of the first lid 21 and the first longitudinal side 29 of the second lid 23;

characterized in that the fastening means comprise:

a first groove 37 that is substantially longitudinal, having a dovetailed cross-section, said groove 37 comprising the member 7, and opposed first 43 and second 45 lateral walls and edges 47, 49 projecting from said lateral walls, a first rim 51 defined by a first tongue 52 and by a portion of the first longitudinal side 27 of the first lid 21 attached to the first tongue 52, said rim 51 having a cross-section substantially in the shape of a reverse "Z"; wherein the first tongue 52 of the first rim 51 is shaped to fit against the member 7 and a portion of the first rim 51 is shaped to fit against the first lateral wall 43 of the groove 37, when the first lid 21 is fastened;

a second rim 55 defined by a second tongue 56 and by a first longitudinal side 29 of the second lid 23 attached to the second tongue 56, said second rim 55 having a cross-section substantially in the shape of a "Z"; wherein the second tongue 56 of the second rim 55 is substantially parallel with the member 7 and a portion of the second rim 55 is shaped to fit against the second lateral wall 45 of the groove 37, when the first 21 and second 23 lids are fastened.

Preferably, tongues 52 and 56 are of the same width, the first tongue being of a size similar to that of the member 7 of the groove 37. Thus, the second tongue 56 is slightly bowed upwardly when fitted against the first tongue 52 when the first tongue is already fitted into the groove 37. One of the advantages of this is to insure the maintaining of the second tongue 56 in the groove 37 because said tongue 56 cannot return to its original shape without first having to be flexed and shaped to get out of the groove 37.

Advantageously, the angle between lateral walls 43, 45 with respect to an orthogonal plane with the member 7 is about 10°.

Advantageously, each tray 9, 11 further shows protuberances uniformly distributed on the periphery of the latter, and in that said lids 21, 23 show at least one cavity where can be housed said protuberances of one corresponding tray when said lid is in a closed position in order to allow protuberances and said cavity to cooperate mutually and in combination with the fastening means and hinge means to give still more sturdiness to the box.

Preferably, pockets 15 of the first tray 9 are each surrounded by four protuberances 16, and there is one row of seven protuberances 16 that is adjacent to member 7, each protuberance of said row being provided with a lateral face defining the lateral wall 43 of the groove 37, and one top face defining with said lateral edge the edge 47. Similarly, pockets 19 of the second tray 11 are each surrounded by four protuberances 18, and there is a row of seven protuberances 18 that is adjacent to member 7, each of said protuberances of said row being provided with one lateral face defining the lateral wall 45 of the groove 37, and with one top face defining with said lateral face the edge 49.

Preferably, the lid 21 presents a shoulder 30 that corresponds to a cavity intended to receive protuberances 16 and the lid 23 shows a shoulder 38 that corresponds to the cavity intended to receive protuberances 18. Furthermore, said shoulders provide more sturdiness to lids 21, 23. In a particularly preferred way, the portion of the first longitudinal side 27 that is partly defined in the first rim 51 includes at least one part of the shoulder 30, and the portion of the first longitudinal side 29 which defines the second rim 55 includes at least in part the shoulder 38.

Advantageously, trays 9, 11 may be further provided with reinforcing rims 10, 12 which are integral parts of said trays, and lids 21, 23 may be further provided with reinforcing rims 20, 22 which are integral parts of said lids. Preferably, said rims 10, 12, 20 and 22 form an integral part of said semi-rigid and molded sheet of plastic material. More particularly, as illustrated in the drawings, rims 10, 12, 20 and 22 form an integral part of the sides 13, 17, 25 and 31, and the first and second hinge means are respectively connected to the rims 10 and 20, and 12 and 22. According to particularly preferred characteristics of the invention illustrated in the drawings, rims 10, 12, 20 and 22 are substantially parallel to the member 7, when the box is closed.

Advantageously, the top of lids 21, 23 may be provided with reinforcing ribs 32, 34. These ribs are advantageous to avoid deformation or warping of the lids when the box according to the invention is being manually closed. Preferably, these rims are provided on the whole periphery of the top of each lid and are further intended to allow a housing for the underneath portion of pockets 15, 19 of another box when stacking the boxes according to the invention.

The semi-rigid and molded single sheet of plastic material may consist of any kind of semi-rigid plastic material that is moldable and well-known in the art of the invention. Advantageously, the thickness may vary between large limits and it is not an important characteristic of the invention, insofar as said sheet has sufficient stiffness to be handled easily and has enough elasticity to allow rims 51 and 55 to be folded and interconnected inside the groove 37. Of course, said sheet may be molded by any appropriate technique well-known to one skilled in the art.

Advantageously, even though any semi-rigid and molded plastic material can be used, the sheet of semi-rigid and moldable plastic material may consist of PVC (PolyVinyl Chloride), PETG or HIPS (High Impact PolyStyrene) having a thickness varying from 10 to 30 mil., preferably about 15 mil. The molding is carried out by all appropriate techniques and preferably by thermoforming.

Advantageously, in cases where the distance separating walls 27 and 29 is too small to allow a person to easily slide the tip of his finger against the tongues of the first and second rims, each of said walls may present, eventually with the top wall of the lids, one or several cavities 46 and 48. Preferably, these cavities 46 and 48 are vis-à-vis each other and uniformly distributed on the length of lids 21, 23.

Advantageously, the top surface of member 7 and the longitudinal center of each molded hinges 33 and 35 are coplanar and preferably, the top surface of member 7, the upper face of rims 20 and 22 and the tongues 52 and 56 and the top face of rims 10 and 12 are coplanar with a longitudinal center for each hinge 33 and 35.

In order to use an egg box as illustrated in the drawings, the opening and the closing of the latter may be carried out as follows:

i) Opening of an egg box 1 by a consumer.

When a consumer wants to take an egg 63 from one of the said egg-receiving pockets 19, he only has to grasp the lid 23 in one hand and the remainder of the box in the other hand to lift said lid 23 until the second rim 55 is flexed and removed from the groove 37, then to tilt said lid 23 along a longitudinal axis defined by the molded hinge 35. Then, if he wants to have access to the row of egg-receiving pockets 15, in order to take one egg from this row, he only has to grasp the lid 21 with one hand and the remainder of the box with the other hand, and then to lift said lid 21 until the rim 51 is flexed and removed from said first groove 37, then to tilt said lid 21 along its molded hinge 33.

Optionally, the consumer may introduce the tip of a knife blade at one end of the groove 37, to lift one part of said rim outside from said groove 37 and then to slide the edge of the blade alongside and between the groove 37 and the rim 55 in order to move said rim 55 outside of said groove 37. Once the tongue 56 is freed from the groove 37, the lid 23 is tilted along the longitudinal axis defined by the molded hinge 35. Then, if he wants to do so, he may insert the tip of a knife blade at one end of the first groove 37 to lift one part of said rim 51 outside groove 37 and then to slide the edge of the blade alongside and between said groove 37 and the rim 51 in order to move the rim 51 outside said groove 37. Once the tongue 52 is freed from the groove 37, the lid 21 is tilted along its longitudinal axis defined by the molded hinge 33.

ii) Closure of an egg box by a consumer.

The consumer simply has to tilt the lid 21 until the rim 51 is positioned above the first groove 37 and then to press said rim 51 to the bottom of said groove 37 by all appropriate means such as applying and/or sliding the tip of one of his fingers against the rim 51 to flex and push it against the bottom of the groove 37. Then, said consumer simply has to tilt the lid 23 until the rim 55 is positioned above the groove 37 and then to press said rim 55 toward the bottom of said groove 37 by all appropriate means such as applying and/or sliding the tip of one of his fingers against the rim 55 to flex it and push it against the bottom of the groove 37. Preferably, the consumer may apply a pressure with the tip of his finger through an access well defined in part by cavities 46 and 48, when the distance separating both lids to too small to allow the insertion of a finger and that both lids have already been tilted respectively on groove 37. According to a particularly preferred embodiment of the invention, the box comprises three access wells and it is possible to lock simultaneously the lids and the member 7 as far as their longitudinal segments are concerned.

Furthermore, even though the particularly preferred embodiments of the invention that are mentioned hereinbefore and illustrated in the drawings are directed to an egg box, the invention also covers boxes for other kinds of articles such as cookies, candies, etc.

Figure 4:
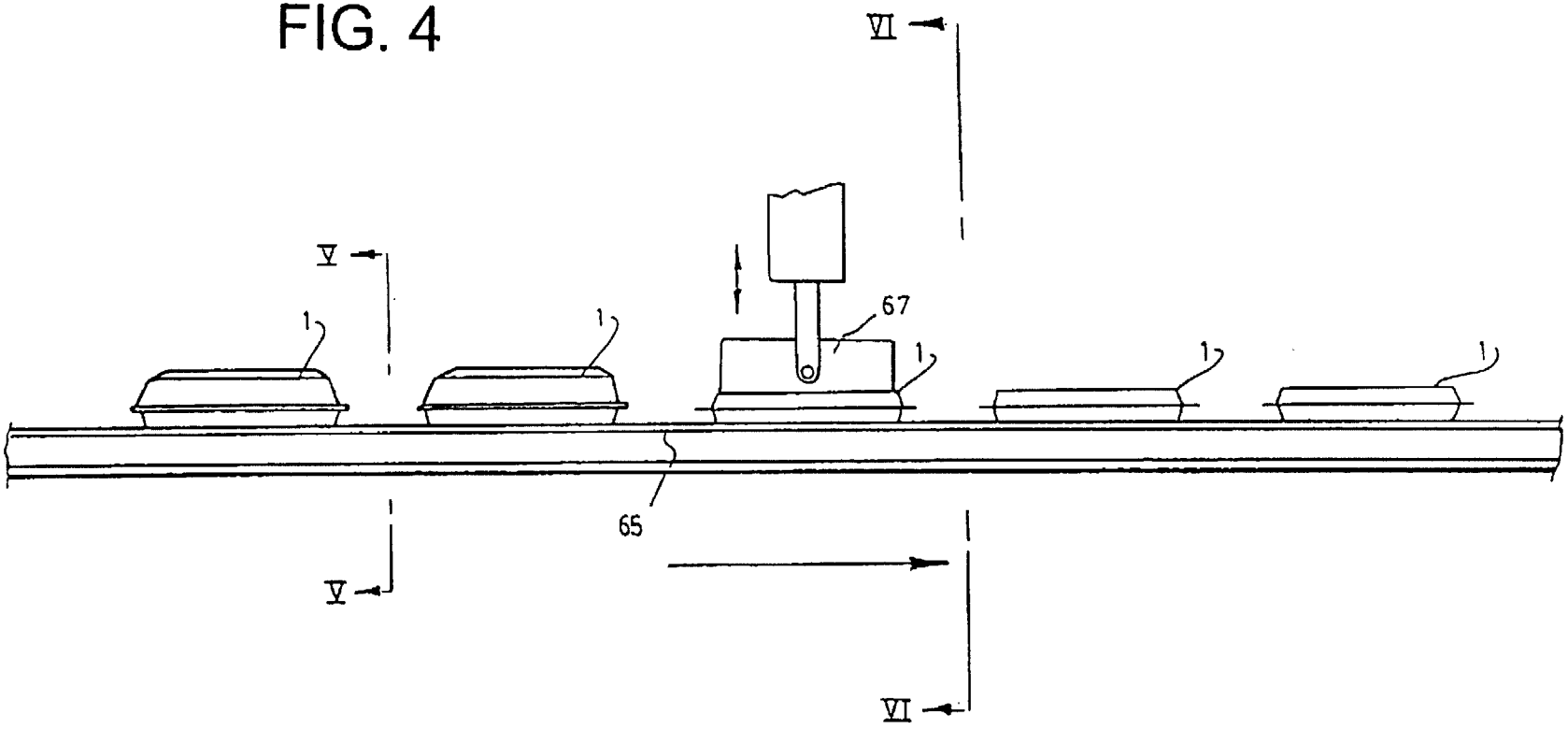
FIG. 4 is a diagram of the elevational side view of an apparatus used for closing the lids and the base of the box shown on FIG. 1.
Figure 5:
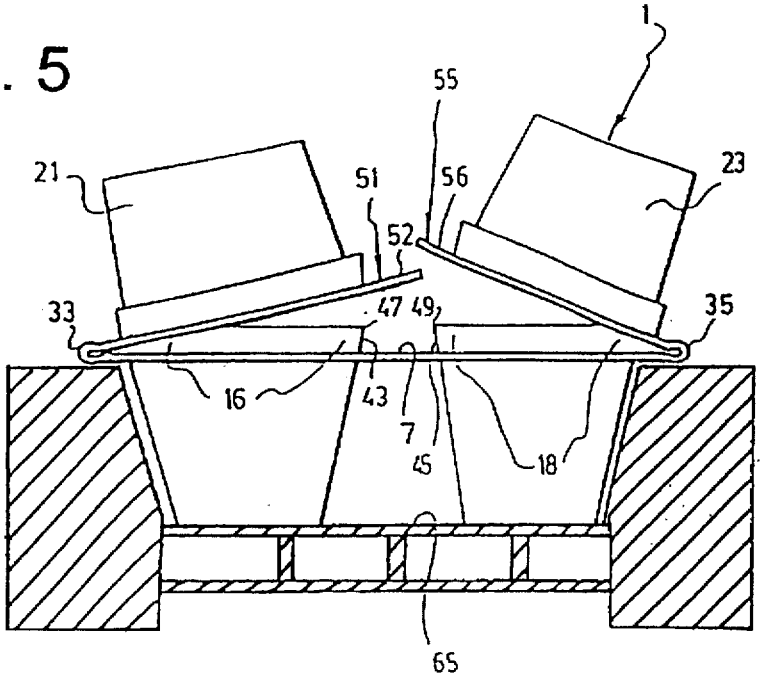
FIG. 5 is a cross-sectional view of the apparatus according to line V—V shown on FIG. 1.
Figure 6:
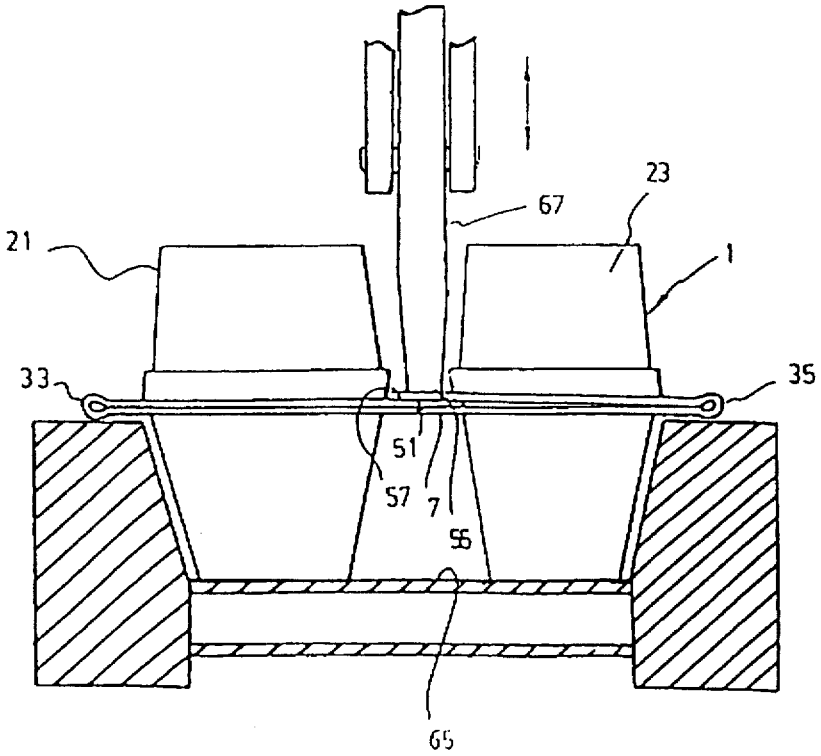
FIG. 6 is a cross-sectional of the apparatus shown on FIG. 4 according to line VI—VI.

The invention also concerns a method illustrated schematically in the FIGS. 4 to 7 of the drawings. More particularly, according to particularly preferred of embodiments of the invention, said method concerns the closure of lids 21 and 23 of a box such as defined hereinbefore. This method is characterized in that at least one box 1, and preferable several boxes 1, are moved along longitudinally on conveyor means, preferably comprising a conveyor belt 65, with its lids 21 and 23 already tilted to have the first rim 51 near the groove 37 and the second rim 55 near the first rim 51 and thereafter, a tool which may consist of a device providing high impact 67 is directly engaged against the second rim 55 to provide within a very short time span for the simultaneous flexing and pushing of the first rim 51 toward the bottom of the groove 37 and of the second rim 55 toward the bottom of the groove 37 with the second tongue 56 over the first tongue 52.

Of course, the present invention also concerns all the variations that may appear obvious to one skilled in the art.

What is claimed is:

1. A box comprising:

a base comprising a member and a first and second tray, said member being positioned between the trays; said first tray having a substantially longitudinal side that is opposite said member and being provided with at least one article-receiving pocket; said second tray having a substantially longitudinal side that is opposite said member and being provided with at least one article-receiving pocket;

a first and a second lid, each lid having a first and a second substantially longitudinal side;

first hinge means for pivotally connecting said second longitudinal side of the first lid with the longitudinal side of the first tray;

second hinge means for pivotally connecting the second longitudinal side of the second lid with the longitudinal side of the second tray;

fastening means to removably fasten together the member, the first longitudinal side of the first lid and the first longitudinal side of the second lid;

characterized in that said fastening means comprises:

a substantially longitudinal groove of dovetailed cross-section defined by the member and opposed first and second lateral walls projecting from said member, wherein each of said first and second lateral walls is attached to a respective one of said trays;

a first rim defined by a first tongue and by a portion of the first longitudinal side of the first lid attached to said first tongue, the first rim having a cross-section substantially in the shape of an reverse "Z";

wherein said first tongue of the first rim is shaped to fit against the member and a portion of the first rim is shaped to fit against the first lateral wall of the groove, when the first lid is fastened;

a second rim defined by a second tongue and by a portion of the first longitudinal side of the second lid attached to said second tongue, said second rim having a cross-section substantially in the shape of a "Z" before being fastened;

wherein the first tongue is between the second tongue and the member, the second tongue of the second rim is substantially parallel with the member, and a portion of the second rim is shaped to fit against the second lateral wall of the groove, when the first and second lids are fastened.

2. A box according to claim 1, characterized in that each tray further shows protuberances uniformly distributed on the periphery of the latter, and in that each lid shows at least one cavity intended to receive the protuberances of a corresponding tray when this latter is in a closed position and to cooperate with said protuberances.

3. A box according to claim 2, characterized in that each article-receiving pocket is surrounded by four protuberances, characterized in that for each tray, there in a row of at least two protuberances adjacent to the member, and characterized in that the lateral face of each of said protuberances adjacent to said member defines with the top surface of this one the periphery of the first groove.

4. A box according to claim 1, characterized in that the angle of each said first and second lateral wall with respect to an orthogonal plane with the member is about 10°.

5. A box according to claim 2, characterized in that each lid has its sides provided with at least one reinforcing shoulder of a cavity for the protuberances of a corresponding tray.

6. A box according to claim 1, wherein the member, the trays, the lids and the rims are made of a single sheet of semi-rigid and molded plastic material.

7. A box according to claim 6, characterized in that the hinge means consist of a molded hinge.

8. A box according to claim 7, characterized in that each molded hinge is obtained by molding a semi-circular groove in a portion of the sheet of semi-rigid plastic material positioned between a tray and its corresponding lid.

9. An egg box comprising in a single sheet of semi-rigid and molded plastic material:

a base comprising a member and a first and a second tray, said member being positioned between said trays; said first tray having a substantially longitudinal side that is opposite said member and being provided with a row of egg-receiving pockets; a second tray having a substantially longitudinal side that is opposite said member and being provided with a row of egg-receiving pockets;

a first and a second lid, each lid having a first and a second substantially longitudinal side;

first hinge means for pivotally connecting the second longitudinal side of the first lid with the longitudinal side of the first tray, said first hinge means comprising a molded hinge obtained by the molding of a first hinge groove having a semi-circular cross-section when said first hinge groove is open upwardly between the first tray and the first lid;

second hinge means for pivotally connecting said second longitudinal side of the second lid with the longitudinal side of the second tray; said second hinge means comprising a molded hinge obtained by the molding of a second hinge groove having a semi-circular cross-section when said second hinge groove is open upwardly between the second tray and the second lid;

fastening means to removably fasten together the member, the first longitudinal side of the first lid and the first longitudinal side of the second lid;

characterized in that said fastening means comprises:

in each tray, protuberances uniformly distributed on the periphery in order to have each article-receiving pocket surrounded by four protuberances and a row of protuberances being adjacent to the member in such a way that one lateral face of one row of protuberances of each tray define a substantially longitudinal dovetailed groove having a dovetailed cross-section, said dovetailed groove comprising the member and opposing first and a second lateral opposite walls projecting from said member;

in a first lid, at least one first cavity where the protuberances of a corresponding tray can be housed, and a first rim that is defined by a first tongue and at least one part of said at least one first cavity, the first rim having substantially the shape of a reverse "Z", and being an integral part of the first longitudinal side of the first lid the first tongue of the first rim being shaped to fit against the member of the dovetailed groove and a portion of the first rim fitting against the first lateral wall of the dovetailed groove, when the first lid is fastened;

in the second lid, at least one second cavity where the protuberances of a corresponding tray can be housed, and a second rim that is defined by a second tongue and at least a part of said at least one second cavity, said second rim having substantially the shape of a "Z" before being fastened, and being an integral part of the first longitudinal side of the second lid, wherein the first tongue is between the second tongue and the member, said second tongue of the second rim being substantially parallel with the member of the dovetailed groove, and a portion of the second rim being shaped to fit against the second lateral wall of the dovetailed groove, when the first and second lids are fastened.

10. A box according to claim 9, wherein the angle of each lateral wall with respect to a plane orthogonal with the member is about 10°.

* * * * *